US005954034A

United States Patent [19]

Takagi

[11] Patent Number: 5,954,034

[45] Date of Patent: Sep. 21, 1999

[54] MALFUNCTION DIAGNOSIS APPARATUS FOR EVAPORATED FUEL PURGE SYSTEM

[75] Inventor: Naoya Takagi, Susono, Japan

[73] Assignee: Toyota Jidosha Kabushiki Kaisha, Toyota, Japan

[21] Appl. No.: 08/955,399

[22] Filed: Oct. 21, 1997

[30] Foreign Application Priority Data

Oct. 21, 1996 [JP] Japan ..... 8-278179

[51] Int. Cl.[6] ..... F02M 37/09

[52] U.S. Cl. ..... 123/520; 123/198 D

[58] Field of Search ..... 123/518, 519, 123/520, 521, 198 D

[56] References Cited

U.S. PATENT DOCUMENTS

| | | | |
|---|---|---|---|
| 5,193,512 | 3/1993 | Steinbrenner | 123/198 D |
| 5,220,896 | 6/1993 | Blumenstock | 123/198 D |
| 5,425,344 | 6/1995 | Otsuka | 123/198 D |
| 5,437,257 | 8/1995 | Giacomazzi | 123/198 D |
| 5,690,076 | 11/1997 | Hashimoto | 123/198 D |
| 5,735,252 | 4/1998 | Blumenstock | 123/520 |
| 5,746,191 | 5/1998 | Isobe | 123/198 D |
| 5,765,539 | 6/1998 | Isobe | 123/198 D |

*Primary Examiner*—Carl S. Miller
*Attorney, Agent, or Firm*—Kenyon & Kenyon

[57] ABSTRACT

A malfunction diagnosis apparatus for an evaporated fuel purge system comprises an evaporated fuel processing unit, an air valve arranged between a canister and the atmosphere wherein, when the air valve is open, the canister communicates with the atmosphere and, when the air valve is closed, the canister is sealed from the atmosphere, means for setting, based on an engine operating condition, a time required to lower a pressure within a least a portion of the evaporated fuel processing unit to a predetermined negative value, means for detecting an atmospheric pressure and means for changing the introduction time of the negative pressure in accordance with the atmospheric pressure. Means are provided for determining whether a failure of the evaporated fuel processing unit has occurred based on a pressure change in the system during a predetermined testing time after the predetermined negative pressure has been introduced into the evaporated fuel processing unit by closing the air valve and opening for the changed introduction time the purge control valve.

2 Claims, 8 Drawing Sheets

MALFUNCTION DIAGNOSIS APPARATUS FOR EVAPORATED FUEL PURGE SYSTEM

BACKGROUND OF THE INVENTION

1. Field of the Invention

The present invention relates to an apparatus for diagnosing a malfunction in an evaporated fuel purge system, in which an evaporated fuel in an internal combustion engine is made to adhere to an absorbent in a canister. Then the evaporated fuel is purged to an intake system in the internal combustion engine under predetermined operating conditions.

2. Description of the Related Art

In an internal combustion engine, a sealed evaporated fuel purge system provided to prevent the evaporated fuel in the fuel tank from escaping into the atmosphere, is sealed so that evaporated fuel is contained within a canister wherein it adheres to an absorbent. Thereafter, the adhered evaporated fuel is purged into an intake passage through a purge control valve at a predetermined timing.

In this kind of internal combustion engine equipped with the evaporated fuel purge system, when an evaporated fuel passage is damaged or pipes are disconnected, the evaporated fuel escaped into the atmosphere. To prevent this, it is necessary to detect whether or not any malfunction in the evaporated fuel purge system has occurred. For this purpose, generally, the internal combustion engine equipped with the evaporated fuel purge system is provided with a malfunction diagnosis apparatus.

In a conventional malfunction diagnosis apparatus for an evaporated fuel purge system, an air valve is provided to an air induction port of a canister. In this kind of malfunction diagnosis apparatus for evaporated fuel purge systems, when diagnosing malfunctions, the air valve is closed so as to seat the canister from the atmosphere, the purge control valve is held open at a predetermined degree of opening so as to introduce a negative pressure from the intake pipe to the system to maintain the purge system at a predetermined negative pressure. Then, the purge control valve is closed and pressure changes after the purge valve is closed are detected. When the degree of the pressure change is larger than the judging value, it is judged that the malfunction such as failure has occurred in the system. When the value is smaller than the judging value, it is judged that there is no malfunction. An example of this pressure action when diagnosing malfunctions is shown in FIG. 8.

Thus, the malfunction diagnosis apparatus for evaporated fuel purge systems provided with an air valve is advantageous in that diagnosis can be quickly made in the negative pressure since the negative pressure is introduced by sealing the canister from the atmosphere.

Moreover, in the malfunction diagnosis apparatus for evaporated fuel purge systems including an air valve, there is one type in which the canister and the fuel tank are communicated as one system so as to conduct the malfunction diagnosis simultaneously, while there is another type in which a tank internal pressure control valve is provided between the canister and the fuel tank and the malfunction diagnosis is conducted separately using a tank internal pressure control valve in the tank side and in the canister side.

In this type of apparatus equipped with an tank internal pressure control valve, the diagnosing time can be shortened because the malfunction diagnosis is conducted in each closed space of small capacity by separating two systems of the tank side and the canister side. Thus, the purge interruption time can be shortened. Therefore, a reduction in evaporated fuel processing ability is decreased and when the purge is restarted after the malfunction diagnosis, the air fuel ratio will be more properly controlled.

Incidentally, it is necessary to maintain the system subjected to the diagnosis at a predetermined target negative pressure when diagnosing malfunctions so as to increase accuracy of the malfunction diagnosis. If the negative pressure in the system changes while a malfunction is diagnosed, the pressure changes may vary even when the same malfunction is diagnosed. Even when the judging value and the judging time are set in the same conditions, a different judging result may be obtained.

However, the degree of valve opening of the purge control valve is not constant, it changes with the operating conditions of an engine. Thus, if the purge control valve is closed simply after opening the valve at a fixed time, the target negative pressure cannot As disclosed in Japanese Patent Laid-Open Publication No. 6-147031, the quantity of purge flow was detected and an introduction time of the negative pressure (i.e., time from closing the air valve to closing the purge control valve) was changed in accordance with the quantity of purge flow.

However, the above technique of changing the introduction time of the negative pressure did not consider influences of the atmospheric pressure value when diagnosing malfunctions to the negative pressure that reaches in the system. Therefore, no trouble will occur when the internal combustion engine is always used under the constant atmospheric pressure, but if the atmospheric pressure is not constant, an erroneous diagnosis may be made.

In other words, internal combustion engines, for automobiles, etc., are driven at high and low altitudes. In such cases, as shown in FIG. 9, the atmospheric pressure values are low at high altitudes and are high at low altitudes.

When the atmospheric pressure value is different as mentioned above, if the purge control valve is opened for the same period because the quantity of purge flow is the same, the target negative pressure does not always reach the predetermined value. Thus, an erroneous diagnosis may be made. This will be a problem regardless of whether a tank internal pressure control valve is provided or not.

SUMMARY OF THE INVENTION

It is therefore an object of the present invention to provide a malfunction diagnosis apparatus for evaporated fuel purge system in which the above described problems are eliminated. More specifically, the present invention is to provide a malfunction diagnosis apparatus that always sets a system subjected to the diagnosis at a target negative pressure and increases the accuracy of malfunction diagnosis for the evaporated fuel purge system by changing the introduction time of the negative pressure from closing the air valve to closing the purge control valve in accordance with the atmospheric pressure.

To achieve the foregoing object of the present invention, the malfunction diagnosis apparatus for evaporated fuel purge system comprises: an evaporated fuel processing unit for absorbing fuel evaporated in a fuel tank to an absorbent in a canister, and for purging the absorbed fuel in the canister under a predetermined operating condition into an intake system of an internal combustion engine via a purge control valve; and air valve for controlling communication between the canister and atmosphere; malfunction judging means for judging whether or not any failure of the evaporated fuel processing unit has occurred based on pressure changes in the system after introducing an intake negative pressure in the internal combustion engine to a system of the evaporated fuel processing unit after closing the air valve and opening the purge control valve, and closing the purge control valve upon expiration of a negative pressure introduction time set based on the operating condition of the internal combustion engine, wherein the negative pressure introduction time extends from the closing of the air valve to the closing of the purge control valve; atmospheric pressure detecting means for detecting the atmospheric pressure; and introduction time changing means for changing the introduction time of the negative pressure in accordance with the atmospheric pressure.

In this malfunction diagnosis apparatus, the atmospheric pressure is detected each time malfunction detection is performed. The introduction time changing means changes an introduction time of the negative pressure from closing the air valve to closing the purge control valve which was set based on the operating conditions of the internal combustion engine in accordance with the detected atmospheric pressure. Accordingly, the system subjected to the diagnosis always becomes the target negative pressure in spite of the difference of the atmospheric pressure. The operating conditions of the internal combustion engine refer to an engine load, an engine speed, a quantity of an intake air, an intake pressure, a quantity of purge flow, etc.

DESCRIPTION OF THE PREFERRED EMBODIMENT

Preferred embodiments of the present invention will now be described with reference to the accompanying FIGS. 1 to 7. The mode explained below is applied to internal combustion engines for automobiles.

Figure 1:
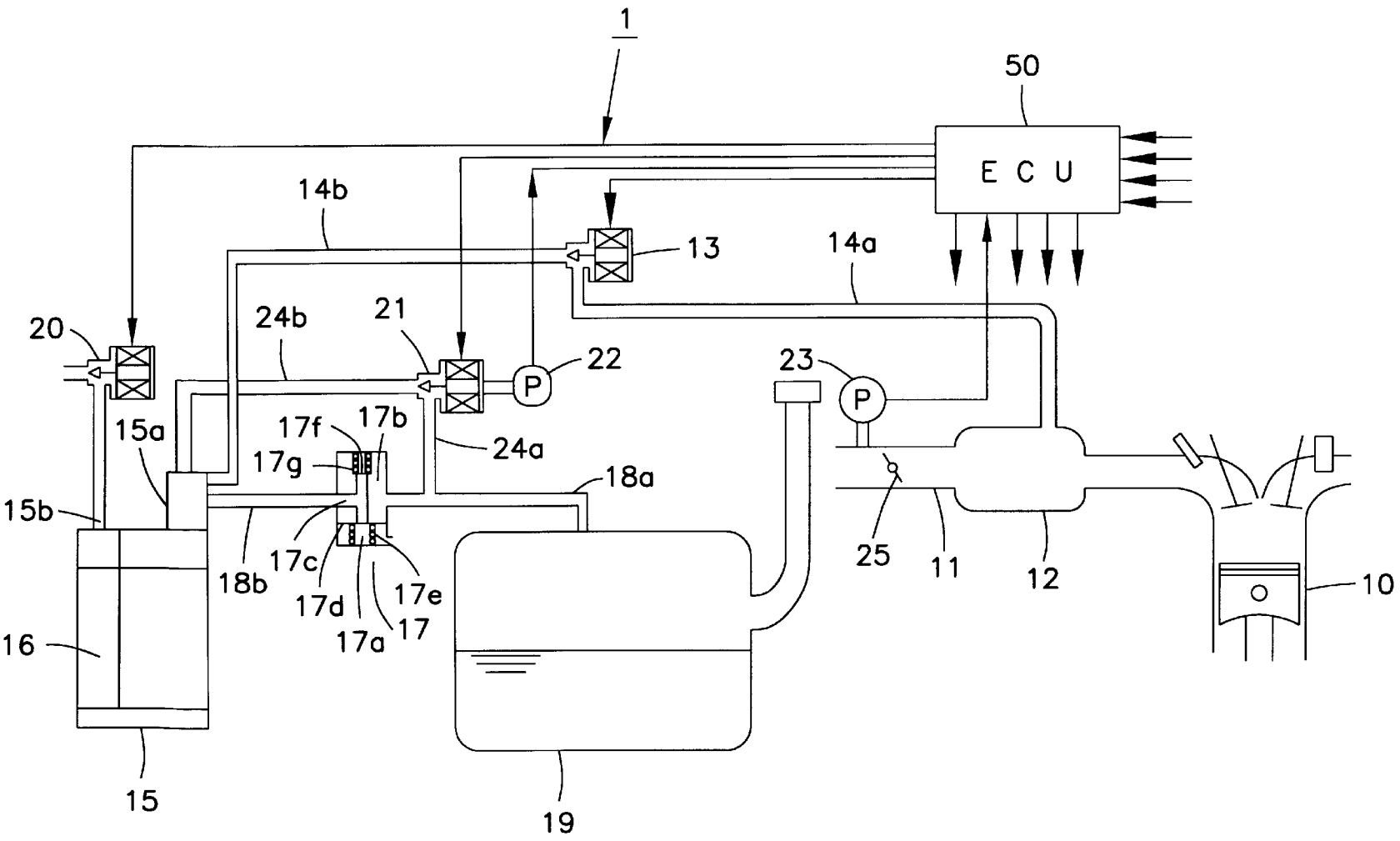
FIG. 1 is a diagram showing the construction of an evaporated fuel processing unit according to an embodiment of the malfunction diagnosis apparatus for evaporated fuel purge system of the present invention.

First, the construction of an evaporated fuel processing unit 1 to which the malfunction diagnosis apparatus according to the present invention is applied, is explained with reference to FIG. 1.

A surge tank 12 of an intake pipe 11 coupled to combustion chambers 10 is connected to an evaporated port 15*a* of a canister 15 via a vacuum switching valve 13 (referred to as the VSV hereinafter) as a purge control valve and purge lines 14*a,* 14*b*.

The degree of opening of the VSV 13 is duty controlled by control signals from an engine control unit 50 (referred to as the ECU hereinafter) when purge conditions are satisfied.

The main component of the ECU 50 is a microcomputer which includes a central processing unit (CPU), a read only memory (ROM), a random access memory (RAM), etc. (not shown). Moreover, the ECU 50 is connected to each sensor such as a throttle valve sensor, a water temperature sensor, an air flow meter, etc. The ECU 50, based on signals supplied from each sensor, performs, e.g., air fuel ratio control, a fuel injection control, etc. and conducts a malfunction diagnosis process for the evaporated fuel purge system which is main point of the present invention.

An atmospheric pressure sensor 23 for detecting the atmospheric pressure is mounted to the upper stream of a throttle valve 25 in an intake pipe 11 and detection signals from the atmospheric pressure sensor 23 are inputted to the ECU 50.

The canister 15 is filled with an active carbon 16 as an absorbent. The evaporated port 15*a* is connected to a fuel tank 19 via evaporated lines 18*a,* 18*b* and a tank internal pressure control valve 17. An air introduction port 15*b* of the canister 15 is connected to the atmosphere via an air valve 20. The air valve 20 is opened and closed based on the control signal outputted from the ECU 50. When the valve 20 is open, the canister 15 and the atmosphere are communicable.

The tank internal pressure control valve 17 includes a first pressure chamber 17*a* for communicating with the atmosphere, a second pressure chamber 17*b* for communicating with the fuel tank 19 via the evaporated line 18*a* and a third pressure chamber 17*c* for communicating with the canister 15 via the evaporated line 18*b*.

The first pressure chamber 17*a* is isolated from the second pressure chamber 17*b* and the third pressure chamber 17*c* by a diaphragm 17*d,* wherein the second pressure chamber 17*b* and the third pressure chamber 17*c* are communicable and scalable with respect to each other. In other words, the diaphragm 17*d* is urged by a spring 17*e* in the direction of closing valve. The second pressure chamber 17*b* and the third pressure chamber 17*c* are sealed closed. When the pressure within the fuel tank 19 becomes larger than a predetermined positive pressure by increase of evaporated fuel e.g., due to an increase in temperature in the fuel tank 19, the diaphragm 17*d* opens against elasticity of the spring 17*e* so that the second pressure chamber 17*b* and the third pressure chamber 17*c* are communicated. The evaporated fuel in the fuel tank 19 is purged to the canister 15 via the evaporated lines 18*a,* 18*b*.

Moreover, the second pressure chamber 17*b* and the third pressure chamber 17*c* are communicable and sealable by a back purge valve 17*f*. That is, the back purge valve 17*f* is urged by a spring 17*g* in the valve closing direction. When the internal pressure in the canister 15 becomes larger than the predetermined value in the fuel tank 19, the back purge valve 17*f* opens against elasticity of the spring 17*g*. Then, the second pressure chamber 17*b* is communicated with the third pressure chamber 17*c* and the fuel tank 19 is communicated with the canister 15 via the air valve 20, the canister 15 and the evaporated lines 18*a*, 18*b* so as to adjust the pressure in the fuel tank 19.

The evaporated line 18*a* that connects the fuel tank 19 and the tank internal pressure control valve 17 and the evaporated port 15*a* of the canister 15 are connected to a three-way switching valve 21 via pressure introducing pipes 24*a*, 24*b*. The three-way switching valve 21 is switched by control signals outputted from the ECU 50 and is communicated with either the evaporated line 18*a* (the canister 15 side) or the evaporated port 15*a* (the fuel tank 19 side) and a pressure sensor 22. The three-way switching valve 21 is generally located in the position of communicating the evaporated line 18*a* and the pressure sensor 22. The detecting signal of the pressure sensor 22 is inputted to the ECU 50.

The evaporated fuel purge system according to the present invention performs as follows.

The air valve 20 is usually opened. The evaporated fuel generating by the increase of temperature of the fuel in the fuel tank 19 is introduced to the tank internal pressure control valve 17 via the evaporated line 18*a*. When the pressure in the fuel tank 19 reaches more than the predetermined value, the fuel is purged into the canister 15 through the evaporated line 18*b* and is absorbed into the active carbon 16.

On the other hand, when temperature of the fuel in the fuel tank 19 drops and the pressure within the fuel tank 19 reaches the predetermined negative pressure, the back purge valve 17*f* opens and the fuel tank 19 is communicated with the atmosphere via the air valve 29, the canister 15 and the evaporated lines 18*a*, 18*b*. Thus, failure of the fuel tank 19 is prevented by controlling the negative pressure within the fuel tank 19.

When the purge execution conditions are satisfied, the VSV 13 opens and the negative pressure in the surge tank 12 is introduced to the canister 15 via the purge lines 14*a*, 14*b*. As a result, the atmosphere via the air valve 20 is led into the canister 15. The evaporated fuel absorbed in the active carbon 16 is purged. The purged evaporated fuel is supplied to the intake pipe 11 via the purge lines 14*a*, 14*b*.

While purging the evaporated fuel to the engine 10, the degree of valve opening of the VSV 13 is duty controlled by the ECU 50 so as to maintain the purge flow not to influence to an exhaust emission by a purge has supply.

According to the evaporated fuel purge system of the present invention, when diagnosing malfunctions of failure in the canister 15 and/or pipes connected therewith, even if the atmospheric pressure differs during diagnosis, it is possible to maintain the constant target negative pressure in the closed space of the canister side 15, thereby preventing erroneous diagnosis due to differences in the atmospheric pressure.

In order so maintain the closed space of the canister side 15 for the malfunction diagnosis at the constant target negative pressure, the following means are adopted. In other words, every time the malfunction is diagnosed, the atmospheric pressure value and the purge flow are checked at that time. Based on the above, an optimum absorption time to obtain a target negative pressure under the condition is calculated in the first expression. The VSV 13 will be closed when the obtained time calculated by the first expression is passed since the air valve 20 was closed.

The first expression:

time to reach a target negative pressure=K×(a target negative pressure×the volume of closed space for diagnosing the canister side)/(the atmospheric pressure×the purged flow)

Further, the K in the above expression refers to a constant set at each malfunction diagnosis system and is obtained by experiments. Still further, the volume of the closed space of the canister for diagnosis refers to a total sum of each volume of the canister 15 including the air induction port 15*b* and the evaporated port 15*a*, the purge line 14*b*, the evaporated line 18*b* and the pipe for introducing pressure 24*b* and this is also a constant set at each malfunction diagnosis system. Moreover, the target negative pressure is also a constant set at each malfunction diagnosis system and, for instance, it is −20 mmHg. Accordingly, the time reach to the target negative pressure is obtained as a function of the atmospheric pressure and the purged flow.

The malfunction diagnosis process according to the present invention will now be described with reference to the drawings.

Figure 2:
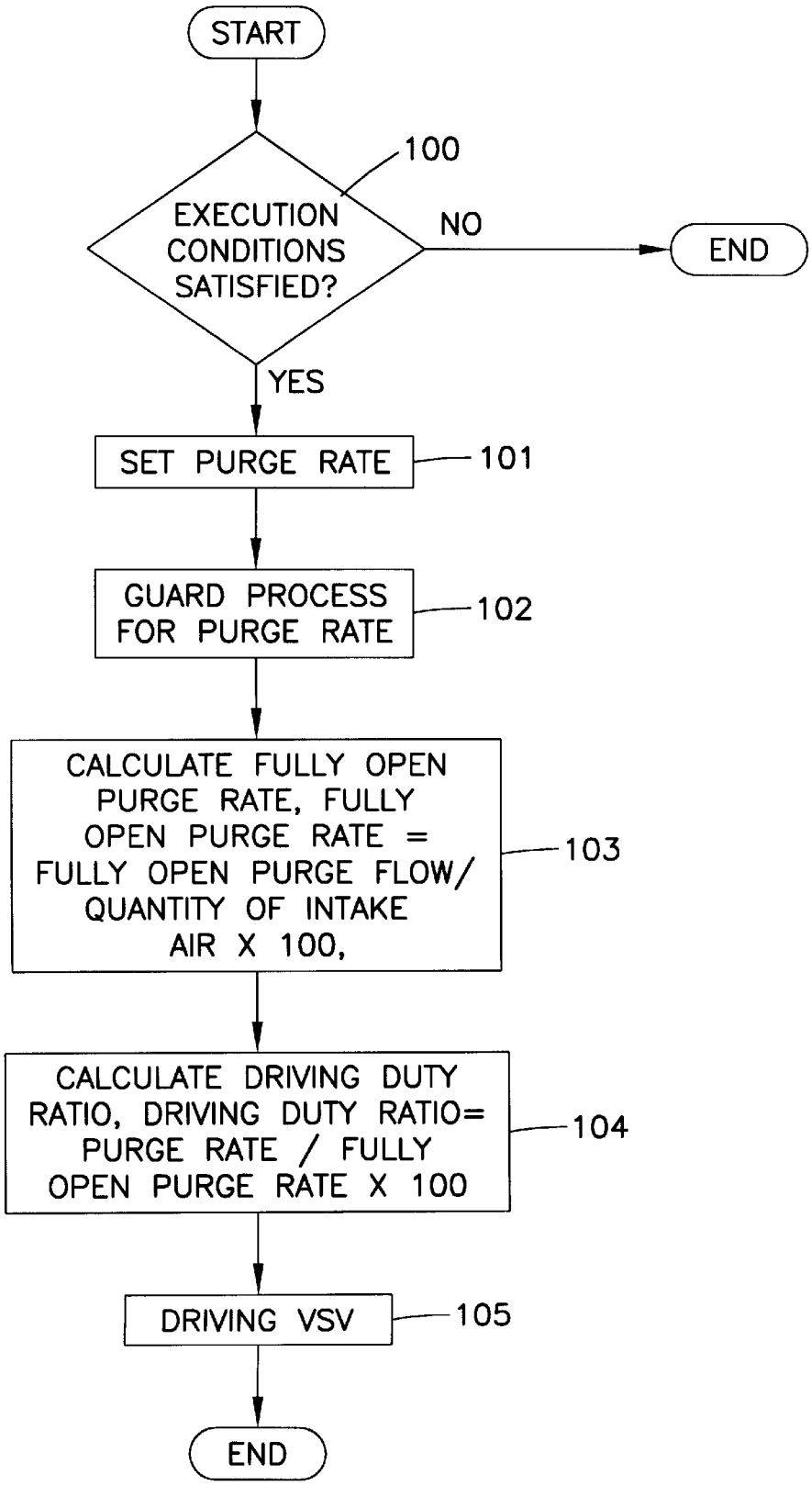
FIG. 2 is a flowchart showing a driving routine of the purge control valve according to an embodiment of the malfunction diagnosis apparatus for evaporated fuel purge system of the present invention.

First, the driving routine of the VSV 13 for purging the evaporated fuel is explained with reference to a flowchart shown in FIG. 2.

When the driving routine of the VSV 13 is started, the ECU 50 first judges whether or not execution conditions (i.e., the engine 10 is warmed up, etc.) are satisfied (step 100).

When the conditions are satisfied, a purge rate is set (step 101). The purge rate is a volume ratio of a quantity of purge to a quantity of intake air and is related to operating conditions such as the quantity of intake air, an engine speed, a negative pressure of intake pipe, load, etc. The relation between the purge rate and the operating conditions of the engine 10 is stored as a map (not shown) in the ROM of the ECU 50 and the purge rate corresponding to the present operating condition is road out referring to the map in the step 101.

Next, a guard process of the purge rate is conducted (step 102). The guard process is the process to check whether the engine 10 will not have any difficulty in safely driving when the purge is executed at the purge rate set in the step 101. When no difficulty occurs, the purge rate set in the step 101 is adopted, but when difficulty occurs, the purge rate will be changed to a purge rate that will cause no difficulty. The purge rate now decided by the guard process in the step 102 is written into the RAM in the ECU 50.

Next, a fully open purge rate will be calculated in step 103 so as to calculate a driving duty ratio for the VSV 13 after the guard process is performed. Herein, the fully open purge rate is the rate when the VSV 13 is fully opened and is a variable varying in accordance with the load state of the engine 10 (e.g., a ratio between the quantity of intake air and an engine speed).

Figure 6:
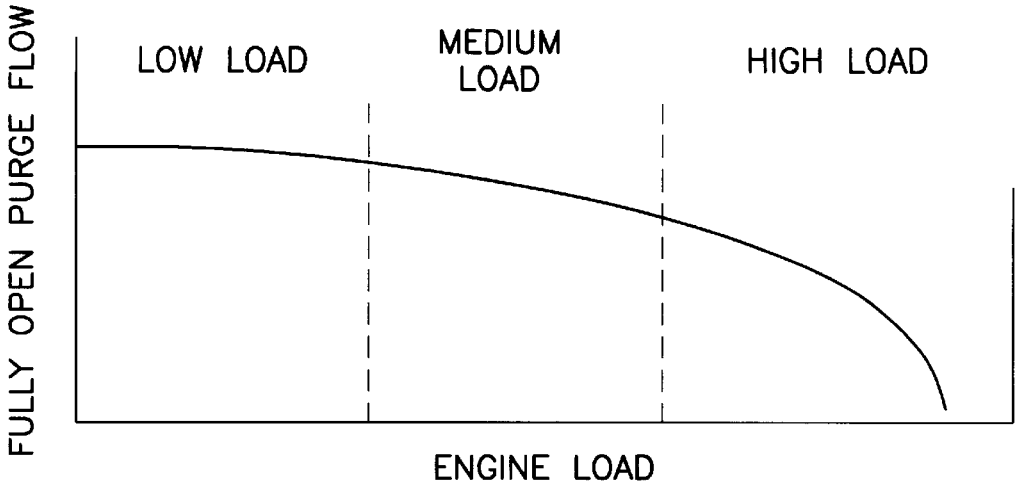
FIG. 6 is a map showing a relation between the fully open purge flow and the engine load according to an embodiment of the malfunction diagnosis apparatus for evaporated fuel purge system of the present invention.

In the ROM of the ECU 50, as shown in FIG. 6, a map showing a relation between the purged flow and the engine load is stored when the VSV 13 is fully opened (referred as fully open purged flow hereinafter). The fully open purged flow corresponding to the present engine load is read out referring to the map. Since the quantity of intake air can be obtained by detection signals of an air flow meter (not shown) inputted to the ECU 50, the ECU 50 calculates a fully open purged rate by a second expression.

The second expression:

a fully open purged rate=(the quantity of fully open purge flow/the quantity of intake air)×100

Next, based on the fully open purged rate calculated by the second expression and the purged rate read out from the RAM after the guard process, the ECU 50 calculates a driving duty ratio for the VSV 13 in the following third expression.

The third expression:

a driving duty ratio=(a purge rate/the fully open purge rate)×100

Thus, the VSV 13 is duty controlled by the obtained driving duty ratio (step 105). The above descriptions are the driving routine for the VSV 13.

Figure 3A:
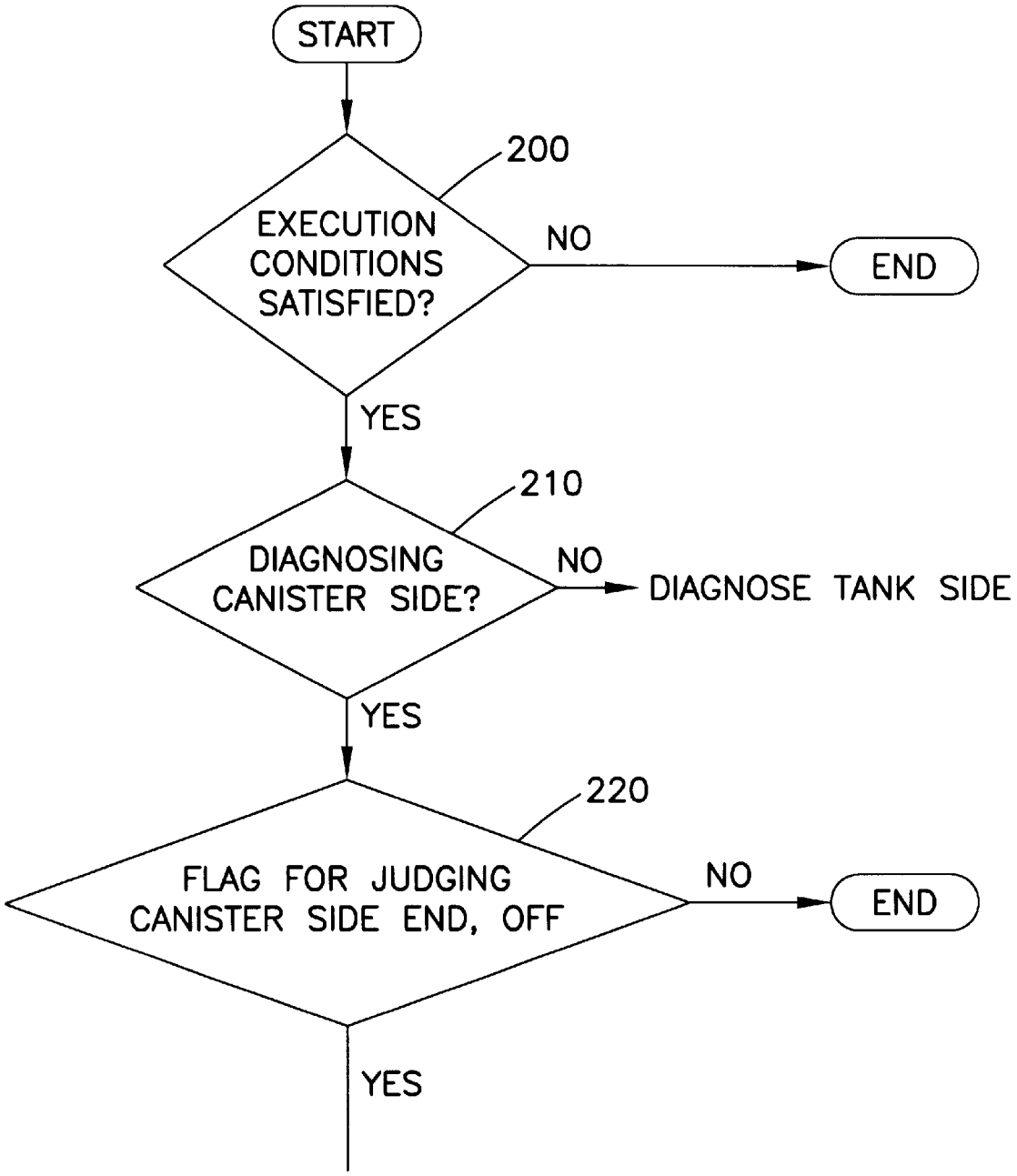
FIG. 3 is a flowchart showing a malfunction diagnosis process routine of the canister side according to an embodiment of the malfunction diagnosis apparatus for evaporated fuel purge system of the present invention.
Figure 3B:
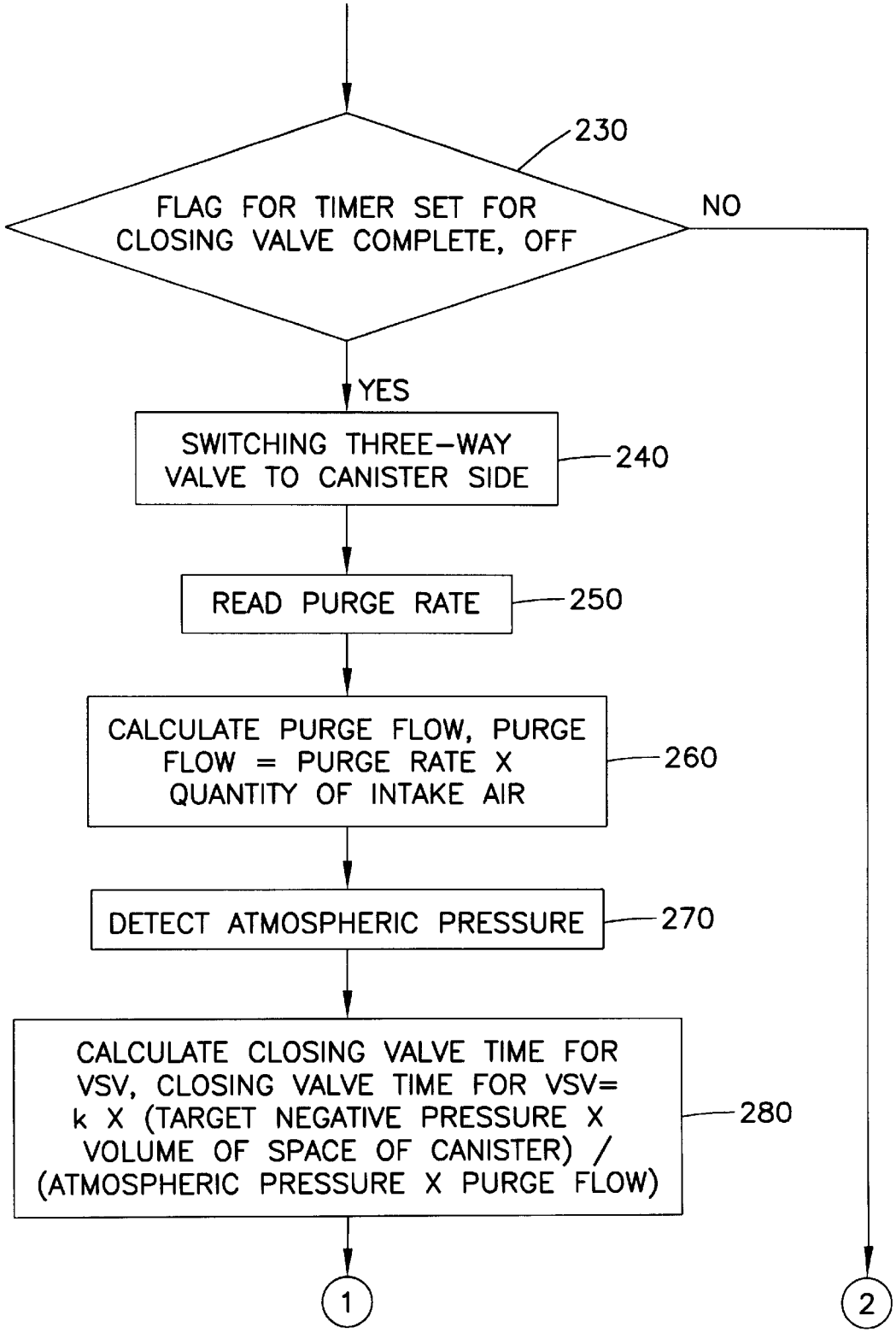
Figure 4:
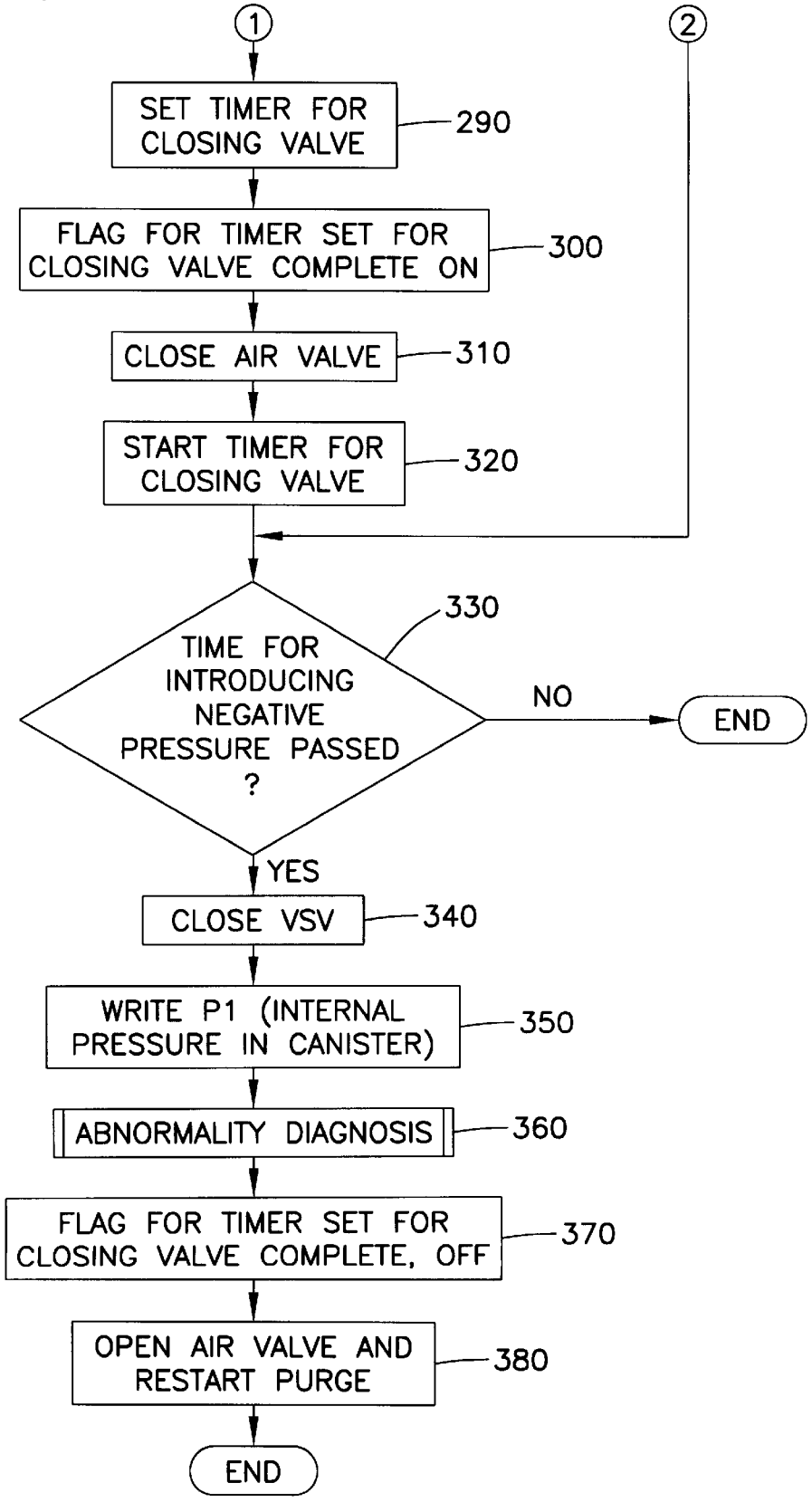
FIG. 4 is a flowchart showing a malfunction diagnosis process routine of the canister side according to an embodiment of the malfunction diagnosis apparatus for evaporated fuel purge system of the present invention.
Figure 5:
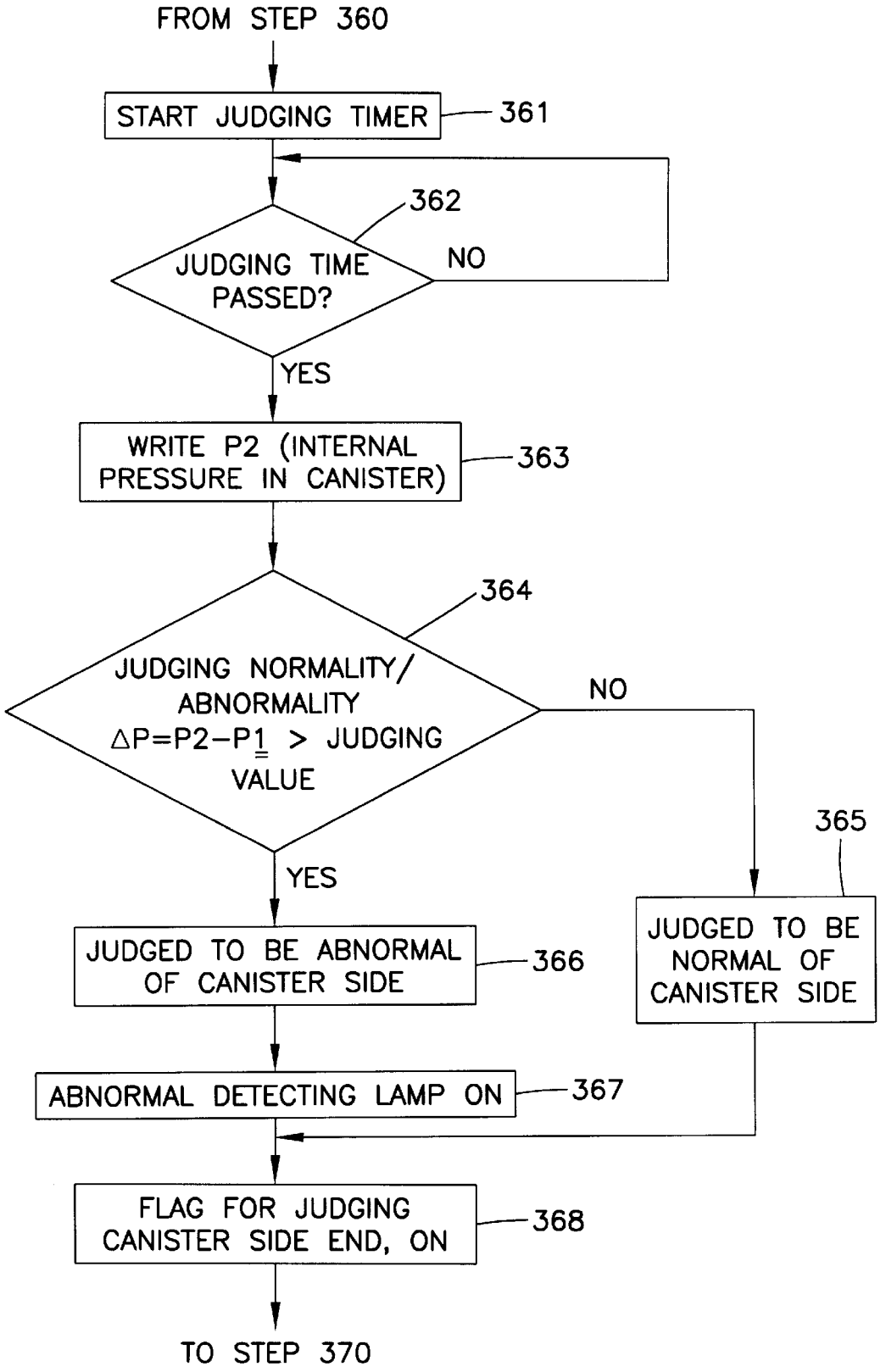
FIG. 5 is a flowchart showing a malfunction diagnosis process routine of the canister side according to an embodiment of the malfunction diagnosis apparatus for evaporated fuel purge system of the present invention.

Next, the malfunction diagnosis process routine for the evaporated fuel purge system of the canister side will not be explained with reference to FIGS. 3 to 5.

This malfunction diagnosis process routine is activated once every predetermined period (e.g., every 65 ms) by the ECU 50.

When the process is started, the ECU 50 judges whether or not execution conditions (for instance, comparing predetermined values with an engine load, a water temperature of cooler, a concentration of purge, the product of the quantity of purge, etc.) are satisfied (step 200).

If the execution conditions are satisfied, a possibility of the malfunction diagnosis of the canister side will be judged (step 210). When it is judged that the malfunction diagnosis of the canister side is not possible, then it is transferred to a malfunction diagnosis routine of the tank side (not shown).

When the malfunction diagnosis of the canister side is possible, whether a flag for judging the canister side end is OFF or not is judged (step 220). This flag is set ON in step 368 mentioned later and when first the malfunction diagnosis routine is activated and the step 220 is executed, the flag is judged OFF since the initial value was set OFF by the initial routine.

When the flag for judging whether the canister side end is OFF, whether a flag for timer set for closing a valve complete is OFF or not is judged (step 230). This flag is set ON in step 300 and OFF in step 370 mentioned later, when initially the malfunction diagnosis routine is activated and the step 230 is executed, the flag is judged OFF since the initial value was set OFF by the initial routine.

When the flag for timer set for closing a valve complete is OFF, the three-way switching valve 21 is switched to the canister side and the pressure sensor 22 and the evaporated port 15*a* of the canister 15 are communicated (step 240).

After the three-way switching valve is switched to the canister side, the ECU 50 reads in the purge rate after the guard process from the RAM (step 250), obtains the quantity of intake air from the detection signals in the air flow meter (not shown) inputted to the ECU 50 and then, calculates the quantity of purged flow in the following fourth expression.

The fourth expression:

the quantity of purged flow=the purge rate×the quantity of intake air

Next, the present atmospheric pressure is detected by detection signals outputted from the atmospheric pressure sensor 23 and inputted to the ECU 50 (step 270). Based on this, the ECU 50 calculates the time necessary for introducing the negative pressure so as to enable the canister 15 to reach a target negative pressure (e.g., −20 mmHg) under the present atmospheric pressure condition. That is, time from closing the air valve 20 to closing the VSV 13 is calculated in the fifth expression (step 280).

The fifth expression:

closing valve time for VSV=K×(a target negative pressure×the volume of space of canister side)/(the atmospheric pressure×the purged flow)

In addition, the fifth expression is substantially the same as the first expression and K is a constant set for each system as mentioned earlier.

Next, the time for introducing the negative pressure obtained from the fifth expression is set to a timer for closing valve (step 290), and the flag for timer set for closing valve complete is set ON (step 300). Then the air valve 20 is closed (step 310) and the timer for closing valve is started (step 320).

Then, after the timer for closing valve is started, whether the time for introducing the negative pressure has passed or not is judged (step 330). In case the time for introducing the negative pressure has not passed, it goes to END.

Since in the first execution of the malfunction diagnosis process routine of the canister side, the flag for timer set for closing valve complete was set ON in step 300, in subsequent executions after the second, it is judged NO in step 230 and proceeds to step 330.

When it is judged that the time for introducing the negative pressure has passed in step 330, the VSV 13 is closed (step 340), and detection signals of the pressure sensor 22 are written into the RAM of the ECU 50 as an internal pressure P1 in the canister 15 (step 350).

Next, it proceeds to step 360 for diagnosing whether the system is normal or abnormal. FIG. 5 is a flowchart showing the contents of step 360. After the internal pressure P1 in the canister 15 is written into the RAM in step 350, a judging timer is started (step 361).

After the judging timer is started, whether the judging time has passed or not is judged (step 362). When the judging time has passed, the detection signal of the pressure sensor 22 is written into the RAM of the ECU 50 as an internal pressure P2 of the canister 15 (step 363).

Then, it proceeds to step 364 for judging whether the system is normal or abnormal. That is, the ECU 50 reads the internal pressures P1, P2 of the canister 15 written into the RAM and calculates the difference of pressure ΔP=P2−P1. When the difference ΔP is smaller than the judging value, it is judged to be normal (step 365) and the flag for judging the canister side end is set ON (step 368) and proceeds to step 370.

On the other hand, when the difference ΔP is larger than the judging value, it is judged to be abnormal (step 366). And an abnormal detecting lamp is turned on (step 367). The flag for the judging canister side end is set ON (step 368) and proceeds to step 370.

The flag for timer set for closing valve complete is set OFF (step 370). The air valve 20 is opened and the purge is restarted (step 380).

When conducting the process described above, it is possible to set the closed space for malfunction diagnosis at the target negative pressure constantly when diagnosing malfunction of the canister side regardless of whether the value of the atmospheric pressure is small or large.

Figure 7:
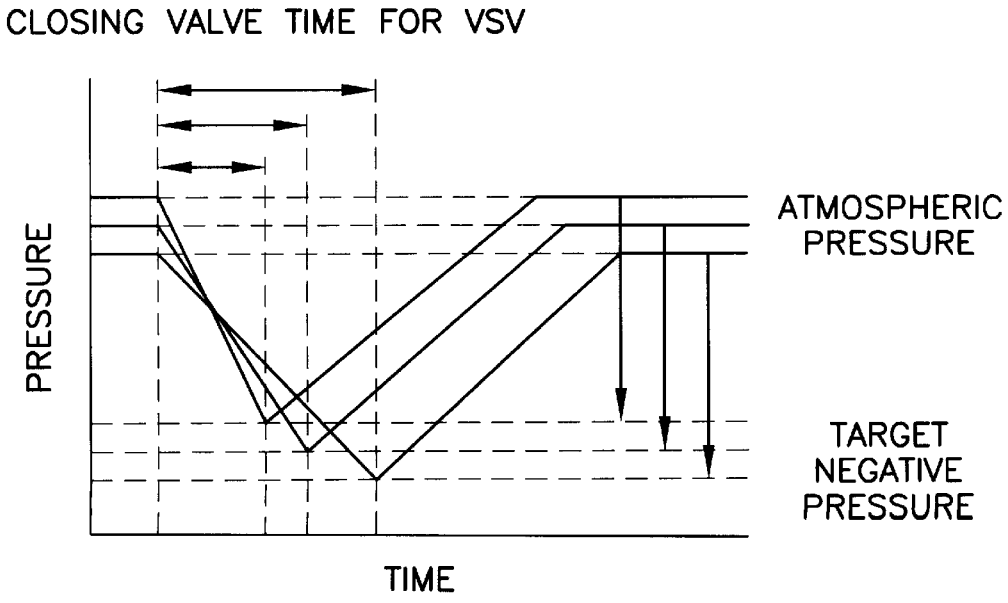
FIG. 7 is a diagram showing pressure actions when diagnosing the malfunction of the canister side according to an embodiment of the malfunction diagnosis apparatus for evaporated fuel purge system of the present invention.
Figure 8:
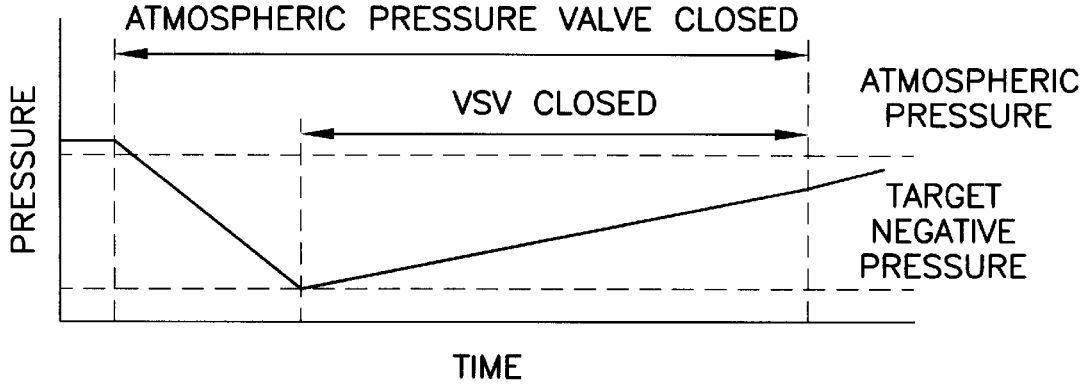
FIG. 8 is a diagram showing pressure actions when diagnosing the malfunction in a conventional malfunction diagnosis apparatus for evaporated fuel purge system.
Figure 9:
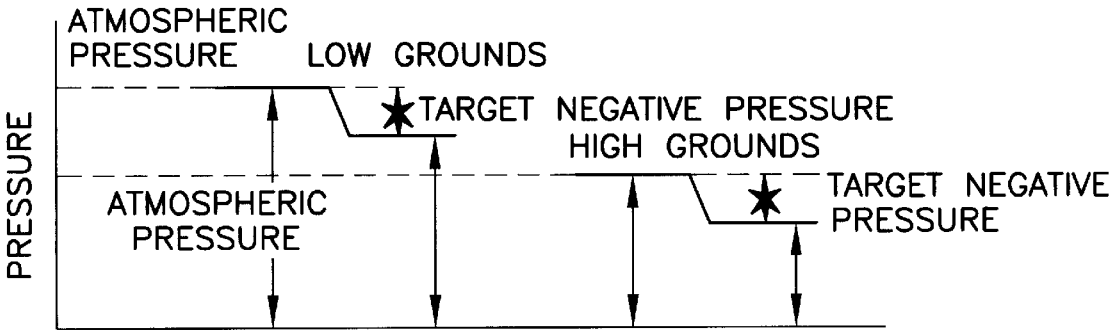
FIG. 9 is a diagram showing the differences of the atmospheric pressure in high grounds and low grounds.

FIG. 7 shows one example of the pressure changes when diagnosing malfunction of the canister side according to the embodiment of the present invention, in which the quantity of purge flow is fixed. In this case, the time from closing the air valve 20 to closing the VSV 13 corresponds to a magnitude of the atmospheric pressure when diagnosing malfunction. When the value is large, the time until the VSV 13 is closed is shortened. While, when the value is mall, the time until the VSV 13 is closed is extended.

Thus, if the negative pressure in the closed space for malfunction diagnosis is constant regardless of the magnitude of the atmospheric pressure, a percentage of the pressure changes accompanied by passage of time after closed the VSV 13 becomes almost the same. Accordingly, for any values of the atmospheric pressure, it is possible to obtain the same judging result so as to prevent an erroneous diagnosis due to the different values of the atmospheric pressure even when conducting the malfunction diagnosis under the same judging criterion.

In this embodiment, the purge control valve is carried out by the VSV 13, the atmospheric pressure detecting means is carried out by the atmospheric pressure sensor 23 and the introduction time changing means is carried out by the ECU 50. Further, the ECU 50 as well as the pressure sensor 22 implement the malfunction judging means.

Moreover, the procedures shown in the flowchart according to this embodiment comprise a computer program which is recordable and distributable in recording medium such as floppy disc, ROM, etc.

The malfunction diagnosis apparatus for evaporated fuel purge system described in the above embodiment is substantially equivalent to a malfunction diagnosis apparatus for evaporated fuel purge system provided with an introduction time changing means which changes a negative pressure introducing time set based on the operating conditions of the internal combustion engine (i.e., engine load, engine speed, quantity of intake air, intake pressure, quantity of purge flow, etc.) in accordance with the atmospheric pressure.

In the above embodiment described, the tank internal pressure control valve is provided and the malfunction diagnosis is conducted separately in the canister side and the fuel tank side but the invention is not limited to the embodiments mentioned above. The invention is also applicable to a system that diagnoses the canister side and the fuel tank side simultaneously as one system.

As described above, according to the present invention, since the introduction time changing means changes the negative pressure introducing time from closing the air valve to closing the purge control valve in response to the atmospheric pressure detected by the atmospheric pressure detecting means, it is possible to maintain the system subjected to the diagnosis always at a target negative pressure regardless of the differences of the atmospheric pressure. As a result, an erroneous diagnosis in prevented and the reliability of the malfunction diagnosis apparatus increases.

What is claimed is:

1. A malfunction diagnosis apparatus for an evaporated fuel purge system for an internal combustion engine comprising:

an evaporated fuel processing unit for absorbing in an absorbent contained within a canister evaporated fuel from a fuel tank, and for purging, under predetermined operating conditions of the engine, the absorbed in the canister into an intake system of the engine via a purge control valve;

an air valve arranged between the canister and the atmosphere wherein, when the air valve is open, the canister communicates with the atmosphere and, when the air valve is closed, the canister is sealed from the atmosphere;

introduction time setting means for setting, based on an engine operating condition, a time required to lower a pressure within at least a portion of the evaporated fuel processing unit to a predetermined negative value;

atmospheric pressure detecting means for detecting an atmospheric pressure;

introduction time changing means for changing the introduction time of the negative pressure in accordance with the atmospheric pressure;

malfunction judging means for judging whether a failure of the evaporated fuel processing unit has occurred based on a pressure change in the system during a predetermined testing time after the predetermined negative pressure has been introduced into the evaporated fuel processing unit by closing the air valve and opening for the changed introduction time the purge control valve, wherein the testing time begins when the purge control valve is closed after the changed introduction time has elapsed.

2. A malfunction diagnosis apparatus according to claim 1, wherein the introduction time changing means obtains the introduction time (t) based on a target negative pressure (Pr), the atmospheric pressure (Pa), a purged flow amount (Qp) and a volume of the portion of the evaporated fuel processing unit into which the negative pressure has been introduced (V), according to the following expression:

$$t=K\times(Pr\times V)/(Pa\times Qp),$$

where K is a constant.

* * * * *

UNITED STATES PATENT AND TRADEMARK OFFICE

CERTIFICATE OF CORRECTION

PATENT NO. : 5,954,034
DATED : September 21, 1999
INVENTOR(S) : Naoya Takagi

It is certified that error appears in the above-identified patent and that said Letters Patent is hereby corrected as shown below:

Column 1,
Line 35, Change "seat" to -- seal --.

Column 2,
Line 19, After "cannot" insert -- constantly be obtained --.
Line 48, Before "evaporated" insert -- an --.
Line 65, Change "and" to -- an --.

Column 4,
Line 54, After "sealed" insert -- when the valve is --.

Column 5,
Line 49, After "purge" change "has" to -- gas --.

Column 6,
Line 36, Change "road" to -- read --.
Line 39, Change "to check" to -- which checks --; after "whether" insert -- or not --.
Line 40, Delete "not".

Signed and Sealed this

Twenty-first Day of August, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 5,954,034
DATED : September 21, 1999
INVENTOR(S) : Naoya Takagi

It is certified that error appears in the above-identified patent and that said Letters Patent is hereby corrected as shown below:

Column 1,
Line 35, change "seat" to -- seal --.

Column 2,
Line 19, after "cannot" insert -- constantly be obtained --.
Line 48, before "evaporated" insert -- an --.
Line 65, change "and" to -- an --.

Column 4,
Line 54, after "sealed" insert -- when the valve is --.

Column 5,
Line 49, after "purge" change "has" to -- gas --.

Column 6,
Line 36, change "road" to -- read --.
Line 39, change "to check" to -- which checks --; after "whether" insert -- or not--.
Line 40, delete "not".

Column 7,
Line 11, change "not" to -- now --.

Column 8,
Line 59, change "mall" -- small --.

UNITED STATES PATENT AND TRADEMARK OFFICE

CERTIFICATE OF CORRECTION

PATENT NO. : 5,954,034
DATED : September 21, 1999
INVENTOR(S) : Naoya Takagi

It is certified that error appears in the above-identified patent and that said Letters Patent is hereby corrected as shown below:

Column 10,
Line 4, before "absorbed" insert -- fuel --.

This certificate supersedes certificate of correction issued August 21, 2001

Signed and Sealed this

Twenty-ninth Day of January, 2002

*Attest:*

*Attesting Officer*

JAMES E. ROGAN
*Director of the United States Patent and Trademark Office*